United States Patent [19]

Hill et al.

[11] Patent Number: 4,695,694

[45] Date of Patent: Sep. 22, 1987

[54] STRUCTURE FOR MINIMIZING MICROWAVE LEAKAGE

[75] Inventors: James D. Hill, Mount Airy, Md.; Gene R. Wooden, Sterling, Va.

[73] Assignee: Fusion Systems Corporation, Rockville, Md.

[21] Appl. No.: 829,343

[22] Filed: Feb. 14, 1986

[51] Int. Cl.[4] ..... H05B 6/76

[52] U.S. Cl. ..... 219/10.55 D; 174/35 MS; 174/35 GC; 361/424; 315/85; 342/1

[58] Field of Search ..... 219/10.55 D, 10.55 R; 174/35 MS, 35 GC, 35 R; 361/424; 343/18 A; 315/85

[56] References Cited

U.S. PATENT DOCUMENTS 2,875,435 2/1959 McMillan ..... 174/35 MS
2,958,754 11/1960 Hahn ..... 219/10.55 D
3,542,939 11/1970 Mintz ..... 174/35 GC
3,594,531 7/1971 Hough ..... 219/10.55 D
3,985,993 10/1976 Imberg et al. ..... 219/10.55 D
4,408,255 10/1983 Adkins ..... 174/35 MS X

FOREIGN PATENT DOCUMENTS 58-192458 12/1983 Japan .

*Primary Examiner*—Philip H. Leung
*Attorney, Agent, or Firm*—Pollock, Vande Sande & Priddy

[57] ABSTRACT

Apparatus for using microwave energy to energize a light source which minimizes microwave leakage from a microwave cavity and yet permits a high percentage of light to be emitted from the cavity. The light transmitting window is made of two spaced-apart parallel screens having microwave energy absorbing material accessible to the zone between the two screens.

8 Claims, 1 Drawing Figure

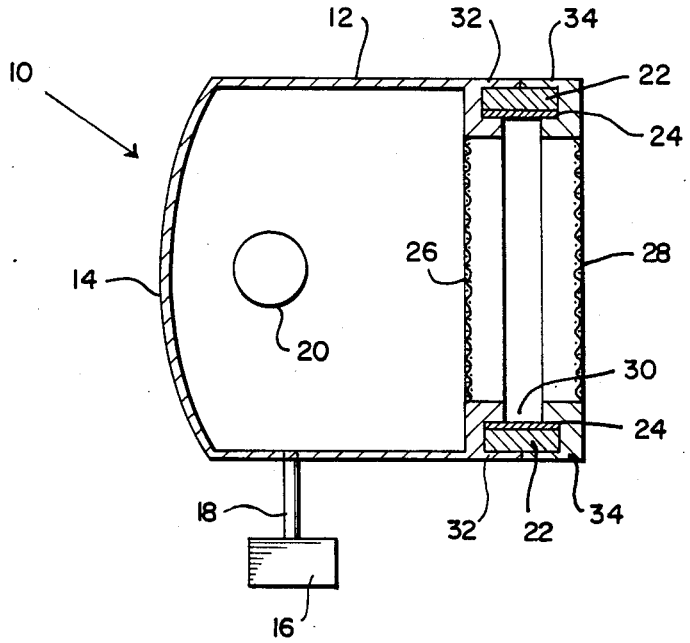
10
12
32
34
22
24
14
26
28
20
30
24
18
32
22
34
16

STRUCTURE FOR MINIMIZING MICROWAVE LEAKAGE

This invention relates to apparatus for using microwave energy, and more specifically, to microwave apparatus having a light-transparent wall.

BACKGROUND OF THE INVENTION

The problem of providing means to permit light to pass into or out of a microwave cavity and yet substantially completely confine microwaves within the cavity, arises in various applications of microwave energy. For example, it is useful for a microwave oven to have a door which is transparent to light so that the interior of the oven is visible with the door closed, and various solutions of the problem of minimizing microwave leakage while permitting light to pass from the interior of the oven have been proposed. For example, U.S. Pat Nos. 4,049,939, 4,206,338 and 4,211,910 disclose various window structures for microwave oven doors which allow the user to monitor the progress of cooking.

These applications of microwave energy for cooking do not present significant problems in shielding since there is need for only enough light to permit the user to monitor the cooking.

There are, however, applications for microwave energy in which it is desirable, or even necessary, for as much light as possible to be emitted from a microwave cavity. For example, there are applications in which microwaves are used to energize a plasma-forming medium and the plasma emits radiation in the ultraviolet which is used as an energy source.

The goal of providing a cavity which is substantially opaque to microwave energy and transparent to light has been achieved to some extent by the use of a metal mesh as part of a wall enclosing the cavity. However, the metal mesh structures which previously have been used which block only a small portion of the radiant energy, such as, for example, 5%, also permit the passage therethrough of a significant amount of microwave energy, for example, about 1% or more of the energy which is generated. Attempts have been made to reduce the amount of microwave energy which escapes from the microwave cavity, while at the same time not significantly reducing the amount of light leaving the cavity. In one such method, screens in series have been used. See, for example, Japanese laid open application No. SHO58-192458 which describes a microwave energized light source in which a portion of the boundary of the microwave cavity includes two parallel mesh surfaces which are separated by a space. While the amount of microwave energy which escapes from the cavity through a combination of two screens is less than that which passes through a single screen, the use of screens in series does not have the beneficial effect that might be expected. First, assuming that the two screens are identical, there is a reduction of only about 50% in the amount of microwaves which escape to the outside over that which escapes when only one screen is used. This is because those microwaves which pass through the first screen are trapped between the screens and have an equal chance of returning into the cavity or exiting through the second screen. Consequently, the second screen blocks the emission of only about 50% of the microwave energy which is in the space between the screens. Secondly, the double screens have the adverse effect of substantially doubling the amount or radiant energy which is blocked.

SUMMARY OF THE INVENTION

It is accordingly one object of the invention to provide an improved structure for transmitting light waves between a microwave cavity and a zone exterior to the cavity and for minimizing the escape of microwave energy from the cavity.

It is another object of this invention to provide apparatus for converting microwave energy to light in which at least a portion of the walls defining a microwave cavity transmits a substantial portion of the light but transmits only insignificant amounts of microwave energy.

In accordance with the invention there is provided apparatus for using microwave energy comprising walls defining a microwave cavity, said walls including structure which permits the passage of light therethrough, means for generating microwave energy, and means for coupling said generated microwave energy to said cavity. The means for permitting passage of light from the microwave cavity comprises a pair of spaced-apart metal screens which form a wall of the cavity, and microwave absorbent material disposed in microwave energy communication with the zone between the two screens so as to absorb microwave energy trapped between the spaced-apart screens.

The combination of spaced-apart screens and absorbent material which is accessible to microwave energy in this space produces a light window which is substantially opaque to the passage of microwaves. A high percentage of the microwave energy which passes through the inner screen is absorbed before it can pass through the outer screen. It is believed that the high absorbency of the microwave energy which escapes from the cavity into the zone between the two screens results from the fact that microwaves are trapped, reflecting back and forth between the screens, and have a high probability of striking absorbing material before passing through the outer screen. This combination of absorbing material and the two screens allows the use of screens which have an improved optical transparency.

BRIEF DESCRIPTION OF THE DRAWING

The FIGURE is a schematic representation in elevation of microwave apparatus incorporating this invention.

DETAILED DESCRIPTION OF THE INVENTION

It is contemplated that this invention will be useful in a variety of applications wherein a wall of a microwave cavity is at least partially transparent to light. However, it is especially useful for applications in which microwave energy is used to activate a plasma-forming medium to produce light, and the invention will be illustrated in detail with such an application.

Referring to the Figure, microwave device 10 is provided with ultraviolet source 20 (supported in the cavity by means not shown) which is activated by microwaves from magnetron 16 by way of waveguide 18. The microwave cavity is bounded by reflector 14, cylindrical wall 12 and a window portion comprising inner screen 26 and outer screen 28. Inner screen 26 is mounted in annular ring 32 and outer screen 28 is mounted in annular ring 34. Annular ring 32 and 34 are shaped to provide annular recess 30 in which radio frequency absorbent material 22 and gasket 24 are located.

While the screens may be substantially identical, having the same mesh size and made from the same size wire, in the preferred method of carrying out the invention the outer screen is made more transparent to light than the inner screen, as by being formed of finer wire and/or having a larger mesh size. For example, it may be necessary to have an inner screen having a sufficient mass so that it will pass no more than about 90% of light in order to provide sufficient conductivity for the microwave energy striking the screen. However, the outer screen is not subjected to the high microwave energy levels to which the inner screen is exposed, and thus may be made less conductive. It therefore can contain less screening materials and may be able to pass 96% or more of light.

The spacing between the two screens is preferably greater than the distance between adjacent parallel wires of the inner screen, and most preferably is in the range of two or more times the distance between adjacent parallel wires. For example, an inner screen made of 5 mil. wire having a mesh size of 0.250 will preferably have a spacing between the screens of from about 0.5 or more inches. The upper limit for the spacing between the two screens is limited only by other structural features of the apparatus for using microwave energy.

In accordance with the invention, radio frequency absorbing material is placed so that it is accessible to those microwaves which are trapped between the inner and outer screens. As a result, only a small percent of the microwave energy which is trapped between the screens escapes to the outside, while as much as 90% or even as high as 99% of the energy which passes through the inner screen is absorbed by the absorbent material.

In the embodiment shown, the absorbent material is physically located between the two screens. However, the absorbent material could also be placed in a zone removed from the screens by providing means for conducting microwaves from the zone between the screens to the absorbent material. For example, a waveguide could be used to transmit microwaves to absorbent material which is in a separate location.

The absorbent material must be capable of absorbing microwaves and in an embodiment such as is shown, the preferred material is a strongly magnetic material such as, for example, ferrite.

In the preferred embodiment as shown in the Figure, the absorbing material is disposed in a recess near the perimeter of the screens so that it does not obstruct the passage of light.

The amount of energy that is trapped between the two screens and is then available for absorption by the absorbing material is relatively low, and consequently no special cooling features are needed for this portion of the apparatus.

EXAMPLE

Apparatus constructed in accordance with the Figure includes parallel screens 26 and 28 separated a distance of 0.5 inch. Inner screen 26 has a mesh size of 0.033 inch and is formed from 1.5 mil wire, while the outer screen 28 has a mesh size of 0.250 inch and is formed from 5 mil. wire. A ring of ferrite as microwave absorbing material 22 is placed in an annular ring between the two screens at their periphery. The ring has a diameter of 4 inches, a thickness of $\frac{1}{8}$ inch and a width of $\frac{1}{4}$ inch.

Light source 20 having an output of 200 nm to 240 nm ultraviolet is energized by magnetron 16 having an energy output of 1.6 kw. Greater than 2 watts of microwave energy passes the inner screen, of which less than 0.1 watt passes the outer screen, the remainder either being absorbed by the ferrite or reentering the microwave cavity.

Nine-one percent (91%) of the light which reaches the plane of the inner surface of the inner screen passes through the openings in the screen and reach the outer screen. The outer screen blocks only about 96% of the light which reaches it; consequently 87.3% of the light passes both screens.

It is to be understood that the term "light" as used herein includes energy in the ultraviolet, visible, and infrared portions of the spectrum, and that the term "cavity" includes microwave structures operated in either resonant or non-resonant modes.

It is also to be understood that it is applicant's intention to cover all modifications of the invention which come within the scope of the invention, which is to be limited only by the claims appended hereto and equivalents.

What is claimed is:

1. Apparatus for using microwave energy comprising walls defining a microwave cavity, said walls including a light window comprising an inner screen and a spaced-apart outer screen, each of said screens being substantially transparent to light and relatively opaque to microwave energy, said apparatus further including microwave absorbing material disposed between the two screens only at or near the periphery of the light window.

2. Apparatus in accordance with claim 1, wherein the distance between the inner screen and the outer screen is at least about 2 times the distance between adjacent parallel wires in the inner screen.

3. Apparatus in accordance with claim 1 wherein said outer screen is more transparent to light than is said inner screen.

4. Apparatus in accordance with claim 1 wherein the microwave absorbing means comprises microwave absorbing material disposed between the two screens at or near the periphery of the light window.

5. Apparatus in accordance with claim 1 wherein the microwave absorbing material is spaced from the zone between the screens and is in microwave communication with the zone between the two screens by waveguide means.

6. The apparatus of claim 1 wherein said microwave absorbing material is in the form of a ring.

7. A microwave light source comprising:

a cavity comprising walls including a light window having an inner screen and a spaced-apart outer screen, each of said screens being substantially transparent to light and relatively opaque to microwave energy;

microwave absorbing material disposed between the two screens only at or near the periphery of the light window;

a bulb containing a plasma-forming medium within said cavity;

microwave source means; and means for coupling microwave energy from said source means to said cavity.

8. The microwave light source of claim 7 wherein said microwave absorbing material is in the form of a ring.

* * * * *

UNITED STATES PATENT AND TRADEMARK OFFICE

CERTIFICATE OF CORRECTION

PATENT NO. : 4,695,694

DATED : September 22, 1987

INVENTOR(S) : Hill et al

It is certified that error appears in the above-identified patent and that said Letters Patent is hereby corrected as shown below:

Cancel claims 4 and 5

On the title page "8 Claims" should read -- 6 Claims --.

Signed and Sealed this

Tenth Day of May, 1988

*Attest:*

*Attesting Officer*

DONALD J. QUIGG

*Commissioner of Patents and Trademarks*